United States Patent [19]

Kenney

[11] 4,367,833

[45] Jan. 11, 1983

[54] TACKER

[75] Inventor: Alan G. Kenney, Over, England

[73] Assignee: Ofrex Group Limited, London, England

[21] Appl. No.: 197,011

[22] Filed: Oct. 14, 1980

[30] Foreign Application Priority Data

Oct. 15, 1979 [GB] United Kingdom ..... 7935722

[51] Int. Cl.[3] ..... B25C 5/00; B25C 7/00

[52] U.S. Cl. ..... 227/8; 227/132

[58] Field of Search ..... 227/8, 132

[56] References Cited

U.S. PATENT DOCUMENTS 3,948,426 4/1976 La Pointe ..... 227/8

4,126,260 11/1978 Mickelsson ..... 227/132

*Primary Examiner*—Paul A. Bell

*Attorney, Agent, or Firm*—Nathaniel A. Humphries

[57] ABSTRACT

A tacker which ejects magazines from a staple on operation of a handle by means of a spring biased striker protruding from the ejections slot. The tacker must first be pressed against the surface so that the protruding portion of the striker is pressed inwardly so that a pawl formed on the operating handle can then engage the striker. It is only then that the tacker can be operated.

4 Claims, 2 Drawing Figures

TACKER

FIELD OF THE INVENTION

This invention relates to a tacker device.

By the term "tacker device" is meant any device adapted to drive staples tacks or the like from the device, the device including a striker that is moved against the bias of a spring and then released to drive a staple, tack or the like from the device.

BACKGROUND OF THE INVENTION

Such devices have been proposed before, but such prior proposed devices have not incorporated a safety device which makes it possible to operate the device only when the device is in contact with the surface into which a staple or tack is to be driven. Thus such prior proposed devices can inadvertently be operated when not in contact with a surface, and thus a staple or tack may be fired from the device, causing serious accidents. It is to be appreciated that the staples or tacks emerge from such devices with a considerable velocity and, if accidentally fired towards a person's face can cause blindness.

OBJECT OF THE INVENTION

It is the object of the present invention to provide a tacker as described above in which the tacker cannot be operated unless the tacker is in contact with a surface.

SUMMARY OF THE INVENTION

According to the broadest aspect of this invention there is provided a tacker, said tacker comprising a magazine for containing staples or the like and means for biassing said staples to one end of the magazine, means defining an ejection slot adjacent said end of the magazine, a striker movable in the ejection slot to eject staples from the tacker, said striker having means adapted to co-operate with a pawl, which pawl forms part of a pivoted handle assembly so that, when the pawl engages the said means the handle can be operated to raise the striker against the bias of a spring, said pawl then being disengaged from the striker to permit the striker to move under the bias of the spring to eject a staple from said guide slot, further spring means being provided to bias said striker, in the rest position, so that one end thereof protrudes from said guide slot, the said means on the striker then being spaced from the pawl so that the pawl cannot engage the said means, the arrangement being such that when the tacker is placed on a surface, the striker is urged into the ejection slot against the bias of the further spring means to bring the said means on the striker into alignment with the pawl so that the pawl can engage the said means on the striker.

Advantageously said means may be defined by an aperture in said striker.

Preferably the spring driving the striker is a leaf spring, one end of the leaf spring being fixed and the other end of the leaf spring being located in an aperture formed in the striker, the aperture having a greater dimension in the direction of movement of the striker than the corresponding thickness of the spring.

Preferably a stop is provided adapted to engage the said leaf spring biassing the striker, said further spring means biassing the striker so that the end of the striker moves out of the ejection slot on completion of ejection of a staple from the apparatus.

BRIEF DESCRIPTION OF THE DRAWINGS

In order that the invention may be more readily understood, and so that further features thereof may be appreciated the invention will now be described by way of example with reference to the accompanying drawings in which.

DESCRIPTION OF PREFERRED EMBODIMENT

Staple tackers are well known and comprise a magazine for containing staples and means for urging contained within the magazine towards an ejection slot. The staples comprise a plurality of substantially "U" shaped members which are secured adjacent one another to form an elongate substantially "U" sectioned strip. A striker is provided which comprises a member movable within the ejection slot. The striker is movable to a position in which the entire striker is located above the magazine, and then resilient means, such as a spring, contained within the magazine cause the staples to advance, thus placing a staple in the ejection slot. On subsequent operation of the tacker the striker moves downwardly rapidly under the force of a spring, thus striking the staple within the ejection slot and forceably ejecting the staple.

Figure 1:
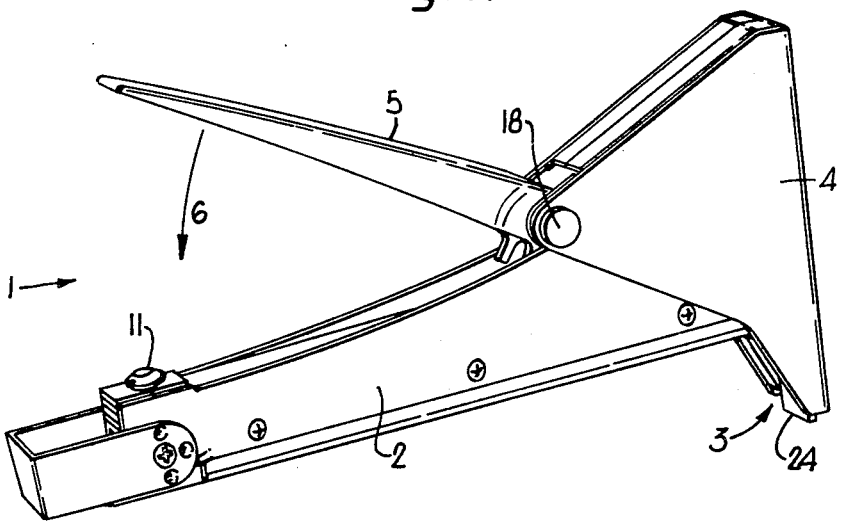
FIG. 1 is a perspective view of a tacker in accordance with the invention and FIG. 2 is a side elevational view of the principal operative parts of the tacker of FIG. 1.

In the tacker 1 shown in FIG. 1 the magazine 2 contains staples which are biassed towards an ejection slot 3. A spring biassed striker, to be described more fully is located within the housing 4 at one end of the magazine 2. A pivotally mounted handle 5 is mounted on the housing, and the tacker 1 is such that when the ejection slot 3 is pressed against a surface and the handle 5 is moved in the direction of arrow 6 a staple is ejected through slot 3 into the surface.

Figure 2:
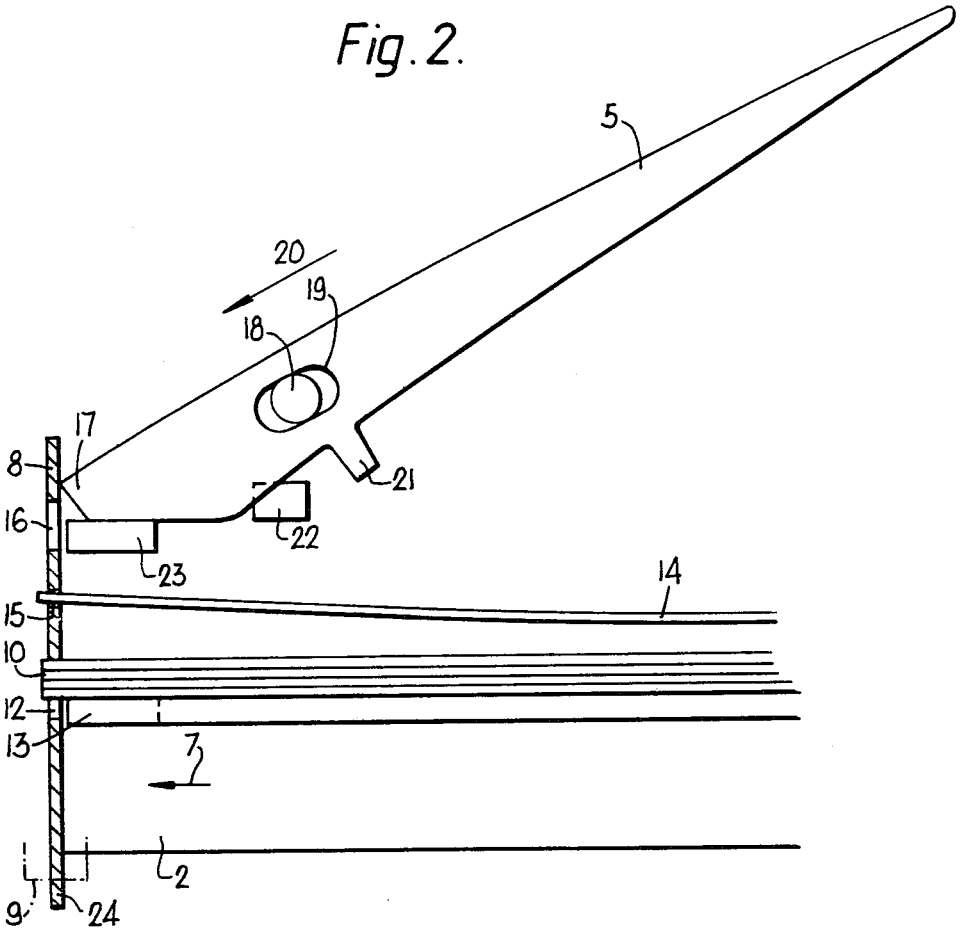

Referring row to FIG. 2 the magazine 2 is adapted to contain staples (not shown) and is provided with means to urge staples to the left, as indicated by the arrow 7 in FIG. 2, towards the ejection slot 3 which is at the left hand end of the magazine 1. A striker 8 formed of a hard metal plate is movable vertically within the ejection slot and the means defining the ejection slot have been omitted for purpose of clarity although the lowermost edge 9 of the means defining the ejection slot 3 is shown in phantom. A strong leaf spring 10 is provided, having one end thereof firmly anchored by rivet 11 and having the free end thereof located within an aperture 12 formed in the striker. The aperture 12 has a slightly greater height in the direction of movement of the striker 8 than the overall height or thickness of the leaf spring 10.

Thus there is a certain freedom of movement of the striker 8 relative to the leaf spring 10 thus forming a lost motion connection between the striker 8 and leaf spring 10. An end stop 13 is provided which limits the downward movement of the leaf spring 10. A second subsidiary leaf spring 14 is provided, which is weaker than the leaf spring 10, one end of this leaf spring 14 also being firmly anchored in position by the rivet 11 and the free end of the leaf spring 14 being inserted into an aperture 15 formed in the striker 8. A further aperture 16 is formed in the striker 8 located above the aperture 15 and this aperture 16 is defined by a surface the upper portion of which comprises follower means which is adapted to be engaged by a pawl 17 which is formed integrally with the handle 5 that can be pivotally moved about a pivot pin 18. The pivot pin 18 passes through an oval aperture 19 formed in the handle 5. The handle 5 is spring biassed in the direction of the arrow 20 (the spring is not shown). The handle 5 has a downwardly extending projection 21 which co-operates with a stop 22 as will be explained herein other. A further stop member 23 is provided to limit movement of the pawl 17 in a downward direction. It is to be noted that, in the position illustrated in the accompanying drawings, the lower end 24 of the striker protrudes beneath the magazine 2, and indeed this lower end of the striker protrudes beyond the end of the ejection slot 3. Also, in the condition illustrated in the accompanying drawings the aperture 16 is not aligned with the pawl 17 and thus the pawl cannot engage the aperture 16 to lift the striker. Consequently the tacker cannot be operated, even if the handle 5 is moved in the direction of arrow 6.

However, when it is desired to operate the tacker the tacker is placed against the surface into which a staple is to be driven, thus applying pressure to the protruding portion 24 of the striker 8. The striker 8 thus moves upwardly against the small biassing force provided by the leaf spring 14. Consequently the lower part of the leaf spring 10 comes into contact with the lower edge of the aperture 12 and, most importantly the aperture 16 becomes aligned with pawl 17. By virtue of the oval aperture 19 in the handle 5 surrounding the pivot pin 18, and the above mentioned spring bias, the pawl 17 can then move into engagement with the aperture 16. Downward movement of the handle 5 in the direction of arrow 6 then causes upward movement of the pawl 17, consequently moving the striker 8 upwardly. As the striker moves upwardly a tension is applied to the leaf spring 10 and thus the striker moves upwardly against the bias of the leaf spring 10. As the handle 5 is pivoted downwardly and the pawl 17 moves upwardly the protrusion 21 formed on the member defining the handle 5 and the pawl 17 engages the stop 22, and subsequent downward pressure applied to the handle 5 causes an axial movement of the handle 5 relative to the pivot pin 18 by virture of the oval aperture 19, thus withdrawing the pawl 17 from the aperture 16. Consequently the striker 8 is released and moves downwardly rapidly under the force applied thereto by the leaf spring 10 and the small additional force applied by the leaf spring 14.

Whilst the striker has been moved to the elevated position a staple has been advanced into the ejection slot, and consequently as the striker 8 moves rapidly downwardly the striker 8 forceably ejects the staple from the ejection slot 3. When the staple has been ejected the striker continues to move downwardly under pressure applied by the spring 10 until the spring 10 engages the stop 13. Subsequently the striker still continues to move downwardly under the force of the biassing effect provided by the spring 14, until again the apparatus is in the condition illustrated in the accompanying drawings. It is to be appreciated that the spring 14 is a much weaker spring than the spring 10 so that when the tacker device is located in position against a surface into which a staple is to be driven the striker 8 can be readily driven upwardly by sufficient distance to enable the pawl 17 to become engaged with the aperture 16.

Whilst the invention has been described with reference to embodiments in which the tacker ejects staples the invention may be applied to other tackers. Again, whilst the invention has been described with reference to an embodiment in which the springs are leaf springs, the springs could be coil springs. Also it is possible that embodiments may be made in which no spring biassing means are provided to bias the handle 5 in the direction of arrow 6.

What I claim is:

1. A stapler, said stapler comprising a magazine for containing staples to be ejected from the stapler and means for biassing said staples to one end of the magazine, means defining an ejection slot adjacent said end of the magazine, a striker movable in the ejection slot to eject said staples from the stapler, a first relatively strong spring for biassing the striker to the ejecting position said striker and said first spring being connected by a lost motion connection so as to permit relative movement between said striker and said first spring, said striker having follower means adapted to cooperate with a pawl, which pawl forms part of a pivoted handle assembly so that, when the pawl engages the said follower means, the handle can be operated to raise the striker against the bias of said first spring, said pawl then being disengaged from the follower means of the striker to permit the striker to move under the bias of said first spring to eject a staple from said guide slot, a second relatively weak spring means for biassing said striker following ejection of a staple to a rest position in which one end of the striker protrudes from said guide slot, said follower means of the striker then being spaced from the pawl so that the pawl cannot engage the said follower means, the arrangement being such that when the stapler is placed on a surface, the striker is moved back into the ejection slot against the bias of the second relatively weak spring means to bring the said follower means on the striker into alignment with the pawl so that the pawl can engage the said follower means on the striker.

2. A stapler according to claim 1 wherein said follower means of the striker comprises an aperture formed in the striker.

3. A stapler according to claim 2 wherein the first relatively strong spring for driving the striker is a leaf spring, one end of the leaf spring being fixed and the other end of the leaf spring being located in a second aperture formed in the striker, the second aperture having a greater dimension in the direction of movement of the striker than the corresponding thickness of the spring so as to define said lost motion connection.

4. A stapler according to claim 7 additionally including a stop for engaging said first leaf spring as the end of the striker arrives at the ejection slot to prevent the first leaf spring from urging the end of the striker outwardly of the ejection slot whereby said second spring means biassing the striker so that the end of the striker is moved out of the ejection slot to a protruding position on completion of ejection of a staple from the apparatus.

* * * * *